US005887492A

United States Patent [19]

De Laney

[11] Patent Number: 5,887,492

[45] Date of Patent: Mar. 30, 1999

[54] MECHANICS' LIMITED-ACCESS NUT STARTER INSTRUMENT AND IMPROVED AIRCRAFT TOOLS

[76] Inventor: Glenn J. De Laney, 2232 Woodview Rd., Apt. 347, Ypsilanti, Mich. 48198

[21] Appl. No.: 869,591

[22] Filed: Jun. 5, 1997

Related U.S. Application Data

[60] Provisional application No. 60/019,382 Jun. 5, 1996.

[51] Int. Cl.[6] ..... B25B 9/00

[52] U.S. Cl. ..... 81/13

[58] Field of Search ..... 81/13, 318, 324, 81/325, 328, 418, 424.5, 426.5

[56] References Cited

U.S. PATENT DOCUMENTS

| | | | |
|---|---|---|---|
| 241,353 | 5/1881 | Grein . | |
| 573,313 | 12/1896 | Tiner . | |
| 715,014 | 12/1902 | Burgess . | |
| 1,293,696 | 2/1919 | Bush . | |
| 1,506,675 | 8/1924 | Seppmann . | |
| 2,397,823 | 4/1946 | Walter | 128/321 |
| 2,454,309 | 11/1948 | Davis | 81/13 |
| 2,642,871 | 6/1953 | Thuerig | 128/321 |
| 3,176,689 | 4/1965 | Yahr | 81/318 |
| 3,312,988 | 4/1967 | Shannon | 7/5.3 |
| 4,206,663 | 6/1980 | Pace | 81/328 |
| 5,181,500 | 1/1993 | Chamberland | 81/426.5 |
| 5,391,181 | 2/1995 | Johnson et al. | 606/207 |

FOREIGN PATENT DOCUMENTS

| | | | |
|---|---|---|---|
| 24739 | 6/1909 | United Kingdom | 81/426.5 |
| 1417637 | 12/1975 | United Kingdom . | |

*Primary Examiner*—David A. Scherbel
*Assistant Examiner*—Benjamin M. Halpern
*Attorney, Agent, or Firm*—Robert Platt Bell & Associates, P.C.

[57] ABSTRACT

A mechanics' limited-access nut starter instrument 1 may provide a precision hexagonal nut holding capability in limited-access mechanical areas commonly encountered by mechanics. Because a hexagonal recess is provided slightly undersized with respect to its intended nut size, the instrument 1 actually begins to hold a nut prior to locking with serrated locking extensions 6*a* and 6*b*. Engaging locking extensions 6*a* and 6*b* will apply a clamping pressure on the held nut. In a second embodiment of the present invention, a pistol-type tool grip may be provided for a tool (including the nut starter of the first embodiment). The pistol-grip afford better gripping and control over the tool, reducing fatigue and more importantly, reducing the risk a tool may be dropped or lost into a limited-access area. A lanyard or the like may be attached to the pistol grip to attach the tool to the wrist of the worker to prevent loss. The lanyard may also be used to hold the tool in a clamped position.

12 Claims, 8 Drawing Sheets

MECHANICS' LIMITED-ACCESS NUT STARTER INSTRUMENT AND IMPROVED AIRCRAFT TOOLS

CROSS-REFERENCE TO RELATED APPLICATIONS

The present application claims priority from Provisional U.S. patent application Ser. No. 60/019,382, filed Jun. 5, 1996 and incorporated herein by reference.

FIELD OF THE INVENTION

The present invention relates to a precision locking tool having hexagonal recesses to clamp and hold a nut and improved grips and retaining means, particularly for aircraft tools.

BACKGROUND OF THE INVENTION

Prior-art nut locking tools existed before the turn of the century, but they were quite different to serve different purposes. For example, U.S. Pat. No. 241,353, issued to Grein on May 10, 1881, discloses an early wrench constructed to hold square nuts typically for use in oiling carriages without soiling of hands. The prior-art wrench has a lateral bend near it square nut clamp to allow hand grasping of a square nut well removed from a contact surface. Its lateral bend, necessitating the pivoting arms to pivot perpendicularly to the rotation of a nut being clamped, makes it inappropriate for any substantial torquing of a nut, especially in limited-access areas. The wrench is also distinguished in that it does not hold hexagonal nuts. These shortcomings make the prior-art wrench inappropriate for clamping and torquing a hexagonal nut in limited-access areas.

A more recent patent, U.S. Pat. No. 2,642,871, issued to Thuerig on Jun. 23, 1953, discloses a pair of locking forceps with tongs so designed to firmly grip tubular objects. The forceps comprise a pair of pivoted members, finger supporting means, and tongs having forward gripping edges. Unlike Grein's wrench, Thuerig's forceps has its pivoting members pivot parallel to the axis of a hypothetical tubular object being held. However, the gripping edges are neither ribbed nor shaped as a hexagonal recess.

British Patent Specification No. 1,417,637, issued to Beauchamp on December of 1975, discloses a hand tool comprising a pair of pivoting arms resembling a pair of pliers. As shown in FIG. 1, two ring halves may close to form a gripping recess having the outline of a twelve-pointed, or a double hexagon, nut. The plane of the two ring halves is inclined with respect to the general plane of the pivoting arms. The prior-art tool is intended for placing twelve-pointed nuts on threaded studs which are inaccessible. The prior-art tool is distinguished in that the gripping edges do not specifically form a hexagonal recess and the prior-art tool does not have locking extensions.

Heretofore, these prior-art tools were lacking in their attributes to clamp, hold, and torque hexagonal nuts of varying sizes in a limited-access working area. Such requirements are particularly useful in aircraft maintenance. When maintaining aircraft, loose tools, nuts, bolts, and other fasteners must be removed from the airplane before the aircraft can be considered airworthy.

Loose fasteners or tools may work their way into parts of the aircraft where that may jam control cables or cause other malfunction. Several air crashes have been caused by stray equipment of fasteners jamming or otherwise interfering with control mechanisms or other aircraft components. As a result, if a mechanic loses a fastener or tool, an aircraft may need to be further disassembled to locate and remove such stray fasteners before the aircraft can be put back in service. Such further disassembly, particularly in wings and the like may be very time consuming.

What is then required is a new and improved mechanics' limited-access nut starter instrument to more effectively clamp, hold, and torque hexagonal nuts of varying sizes in limited-access working areas. In addition, a means for holding and retaining tools when working in such limited access areas is also required.

SUMMARY AND OBJECTS OF THE INVENTION

The present invention contemplates a new and improved mechanics' limited-access nut starter instrument to more effectively clamp, hold, and torque hexagonal nuts of varying sizes in limited-access working areas. Like forceps or hemostats it has two pivoting arms, finger grips, and serrated locking extensions. However, unlike forceps or hemostats, the two pivoting arms form hexagonal recesses when closed. The hexagonal nut recesses are of varying precision sizes. The nut starter instrument may also be available in various sizes.

The pivoting arms of a mechanics' limited-access nut starter instrument may be available slightly bent for oblique angle of gripping. Once locked onto a hexagonal nut by engaging serrated locking extensions, it may be held approximately parallel to a working surface to better withstand torquing of a nut within a limited-access working area.

In a variation of the first embodiment of the present invention, removable heads may be provided for a truncated forceps type device to allow different sized nuts to be gripped without requiring a plurality of nut starters.

In a second embodiment of the present invention, a pistol-type tool grip may be provided for a tool (including the nut starter of the first embodiment). The pistol-grip afford better gripping and control over the tool, reducing fatigue and more importantly, reducing the risk a tool may be dropped or lost into a limited-access area. A lanyard or the like may be attached to the pistol grip to attach the tool to the wrist of the worker to prevent loss. The lanyard may also be used to hold the tool in a clamped position.

It is an object of the present invention to provide a unique mechanics' limited-access nut starter instrument with hexagonal recesses to clamp, hold, and/or torque nuts.

It is a further object of the present invention to utilize the finger grips and serrated locking extensions commonly found with a pair of forceps or hemostats.

It is a further object of the present invention to provide a bend in the pivoting arms for easy gripping within a limited-access working space.

It is a further object of the present invention to provide one or more precision-sized hexagonal nut recesses to clamp, hold, and/or torque nuts upon closure of two pivoting arms.

It is a further object of the present invention to provide a means for improving grip and control over a toll and to provide a means for preventing tools from being dropped in limited access spaces.

BRIEF DESCRIPTIONS OF THE DRAWINGS

FIG. 6 is a side view of a second embodiment of the present invention illustrating the use of an alternative pistol grip and lanyard for a forceps or the like.

DETAILED DESCRIPTION OF THE INVENTION

Figure 1:
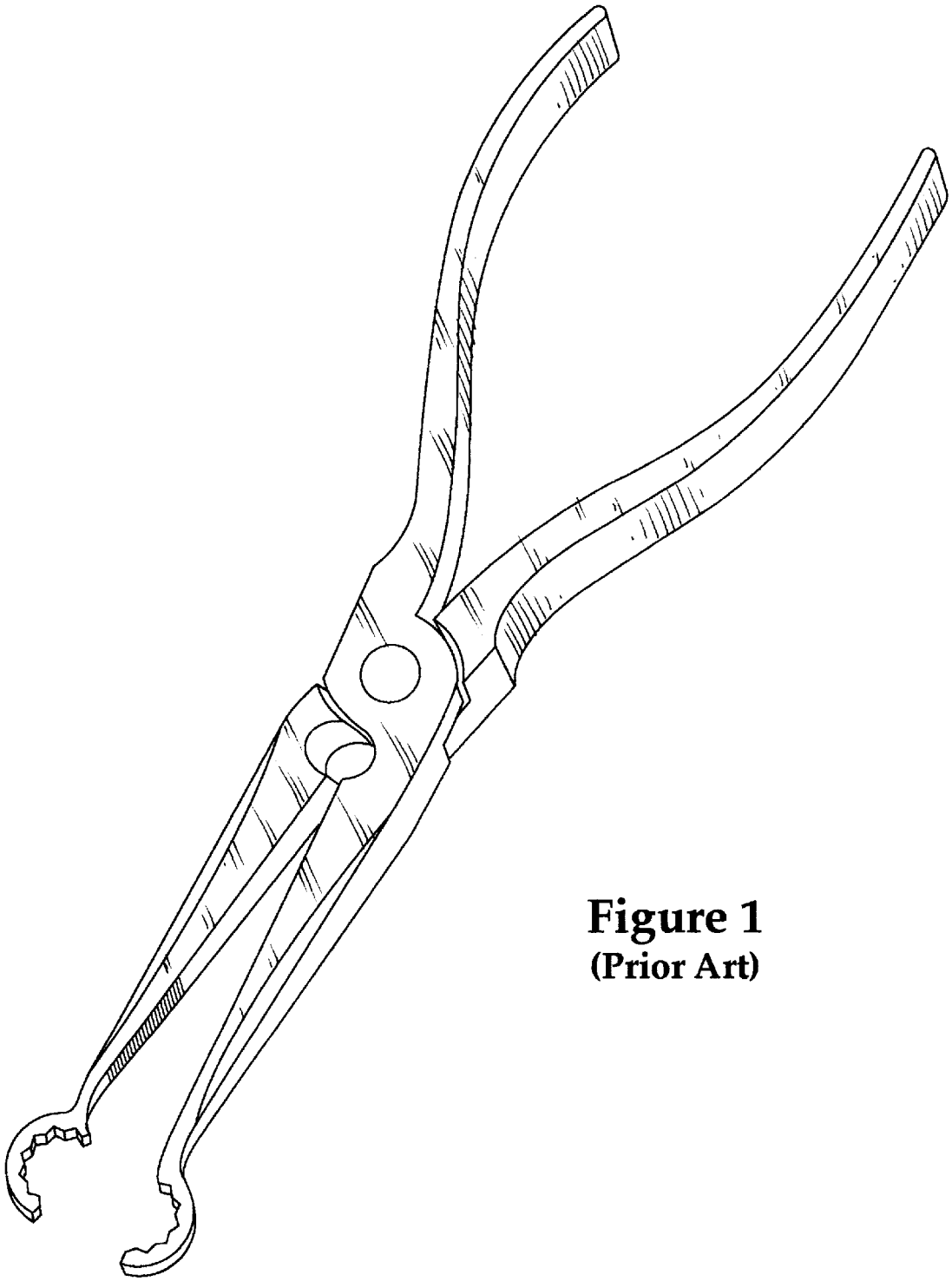
Figure 1 (Prior Art)
FIG. 1 is a perspective view of a prior art hand tool capable of holding a double hexagon nut.
Figure 2:
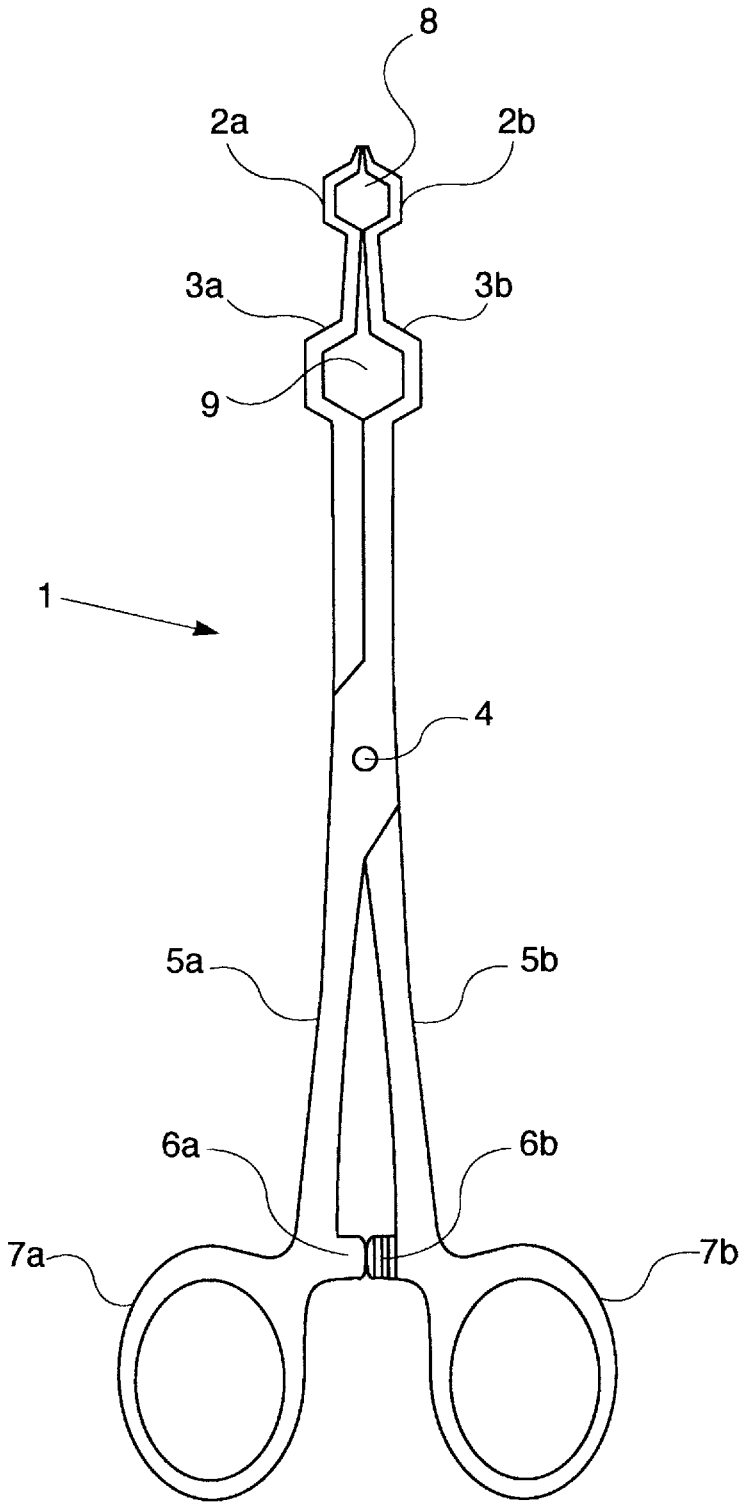
FIG. 2 is a front view of a mechanics' limited-access nut starter instrument.

Shown in FIG. 2 is a front view of the best mode for a mechanics' limited-access nut starter instrument having two arms 5*a* and 5*b,* joined by pivot 4. Pivoting arm 5*a* comprises, among other functional aspects, first ribbed half 2*b*, second ribbed half 3*b*, serrated locking extension 5*a*, and finger grip 7*a*. First ribbed half 2*b* may be of a smaller size than second ribbed half 3*b*. Likewise, pivoting arm 5*b* comprises, among other functional aspects, first ribbed half 2*a*, second ribbed half 3*a*, serrated locking extension 6*b*, and finger grip 7*b*. The nut starter instrument 1 may be available as a 5½" nut starter, which may measure about 6" in length.

Figure 3:
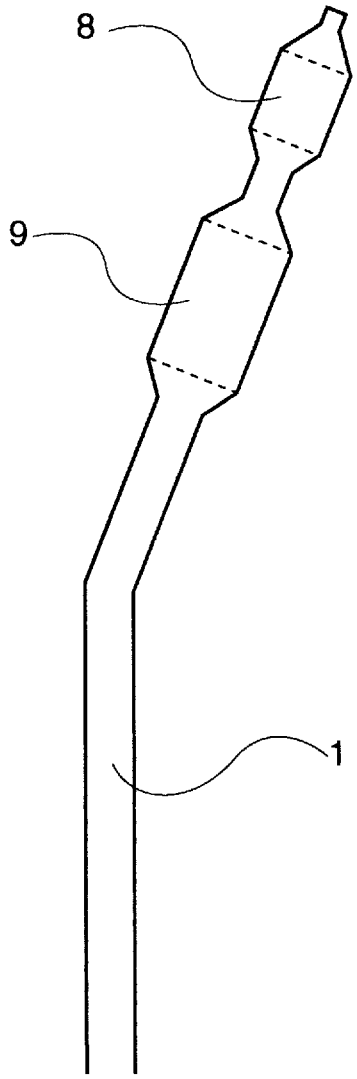
FIG. 3 is a side view of the nut-holding end of a mechanics' limited-access nut starter instrument.

Shown in FIG. 3 is a side view of the nut-holding end of a mechanics' limited-access nut starter instrument 1. Although it is shown with about a 10 degree bend below second hexagonal recess 9, this bend is only illustrative of a mechanics' limited-access nut starter instrument. Both bent and straight versions comprise the best mode for a mechanics' limited-access nut starter instrument 1.

FIG. 3 also illustrates that hexagonal recesses 8 and 9 tend to make the nut-holding end thicker than a common thickness of like-sized forceps. For a 5½" nut starter, hexagonal recesses 8 and 9 may be about ¼" thick, measured laterally along a side view.

First embodiment of a mechanics' limited-access nut starter instrument 1 may clamp and hold ¼" and 5/16" nuts. Hexagonal recesses 8 and 9 may be formed when two pivoting arms 5*a* and 5*b* are closed. First hexagonal recess 8 measures about 7/32" laterally across to snugly hold a ¼" nut. Second hexagonal recess 9 measures about 9/32" laterally across to snugly hold a 5/16" nut. The remaining features are in common with the best mode described above.

Note that the dimensions of the hexagonal recesses are slightly smaller than the nut sizes to be gripped. The inventor has discovered that making the dimensions of the hexagonal recesses equal to the nut size (as would be the case in conventional toolmaking) may result in an instrument which may not effectively grip the nut. In particular, when the serrated locking extensions are engaged and the device is closed, if the inside dimension of the hexagonal recess is equal to the nut size, the nut may not be effectively gripped.

Note that such an embodiment may effectively turn such a nut (as an ordinary wrench will do) but the nut itself may be allowed to slide out axially. Such an embodiment may be unacceptable for a nut starter, as axial pressure may be applied by a bolt or the like, tending to push the nut out of the apparatus. Note that the apparatus of the present invention may be used to grip bolts as well as nuts, and may be suitably modified to grip objects having shapes other than hexagonal.

The inventor has discovered, through experimentation, that if the inside dimension of the hexagonal recess is made smaller than the nut size, the apparatus will firmly grip the nut. In the preferred embodiment of the present invention, the apparatus is made of steel, similar to that used in conventional forceps and hemostats. Such steel has a spring action, so that when the serrated portions are engaged, the jaws of the device are held close by spring tension. In this instance, the hexagonal recesses apply pressure against the outside surfaces of the nut (or bold) firmly holding the not (or bolt) not only against rotational pressure, but against axial pressure as well.

Second embodiment of a mechanics' limited-access nut starter instrument 1 may clamp and hold ⅜" and 7/16" nuts. Hexagonal recesses 8 and 9 may be formed when two pivoting arms 5*a* and 5*b* are closed. First hexagonal recess 8 measures about 11/32' laterally across to snugly hold a ⅜" nut. Second hexagonal recess 9 measures about 13/32" laterally across to snugly hold a 7/16" nut. The remaining features are in common with the best mode described above.

Third embodiment of a mechanics' limited-access nut starter instrument 1 may clamp and hold ½" and 9/16" nuts. Hexagonal recesses 8 and 9 may be formed when two pivoting arms 5*a* and 5*b* are closed. First hexagonal recess 8 measures about 15/32" laterally across to snugly hold a ½" nut. Second hexagonal recess 9 measures about 17/32" laterally across to snugly hold a 9/16" nut. The remaining features are in common with the best mode described above.

All of the above measurements are outside (edge-to-edge) nut size measurements. The measurements provided herein are by way of example only and should not be construed as limiting the spirit and scope of the present invention in any way. Other sizes may be used (e.g., metric or the like) without departing from the spirit and scope of the present invention. Moreover, although FIG. 2 illustrates a device which may grip two different nut sizes, other numbers of gripping elements may be provided (e.g., 1, 3, or the like) without departing from the spirit and scope of the present invention. To provide best access, it may be preferable to provide only one nut size gripping element per nut starter. To reduce the number of nut starters required in a set, multiple gripping elements may be provided.

The present invention may be readily manufactured using techniques used in manufacture of forceps or hemostats. A hemostat is a term used to describe a pair of forceps with a serrated locking unit.

Operation of a Mechanics' Limited-access Nut Starter Instrument

A mechanics' limited-access nut starter instrument 1 may provide a precision hexagonal nut holding capability in limited-access mechanical areas commonly encountered by mechanics.

Generally, to clamp and hold a nut, a matching hexagonal recess is clamped around the nut to be held by closing the instrument 1 until locked. Because a hexagonal recess is provided slightly undersized with respect to its intended nut size, the instrument 1 actually begins to hold a nut prior to locking with serrated locking extensions 6*a* and 6*b*. Engaging locking extensions 6*a* and 6*b* will apply a clamping pressure on the held nut.

To install a nut in a limited-access area, one takes an open nut starter instrument 1 having a hexagonal recess matched to the size of a nut to be held, clamps a nut to be held, and inserts the instrument 1 with the held nut into the limited-access area with fingers firmly inserted through the finger grips 7*a* and 7*b*. If the nut is to be tightened severely, the nut starter of the present invention may be removed once the nut has been threaded and a wrench inserted in its place. While the gripping action of the nut starter of the present invention may allow tightening of smaller nuts, larger nuts may require the use of a sturdier wrench for higher torque values. Hence the name of the present invention is nut starter.

A nut can also be loosened and removed from a limited-access area in a similar manner. One takes an open nut starter instrument 1 having a hexagonal recess matched to the size of a nut to be held, and inserts the instrument 1 into the limited-access access area with fingers firmly inserted through the finger grips 7*a* and 7*b*. A nut is then firmly clamped and held with the instrument 1 while the nut may be loosened from its place of attachment in a conventional manner. For tightly held nuts, a wrench may be used to initially loosed the nut, and the nut starter may then be used to grip the nut for unthreading and removal. The gripping action of the nut starter of the present invention prevents the nut from being lost or dropped during removal.

For a bent version of the nut starter instrument 1, one is allowed an oblique angle of hand grip, allowing a mechanic to hold a nut away from a possible nut-holding surface. However, where such a holding clearance is not necessary, a straight version of the nut starter instrument 1 may be appropriate.

The clamping of a nut by locking the nut starting instrument 1 allows effective holding of a nut in a limited-access area. It also allows an effective countering of, or even engaging of possible torquing of a nut with a firm hand grip of the nut starter instrument 1.

Figure 4:
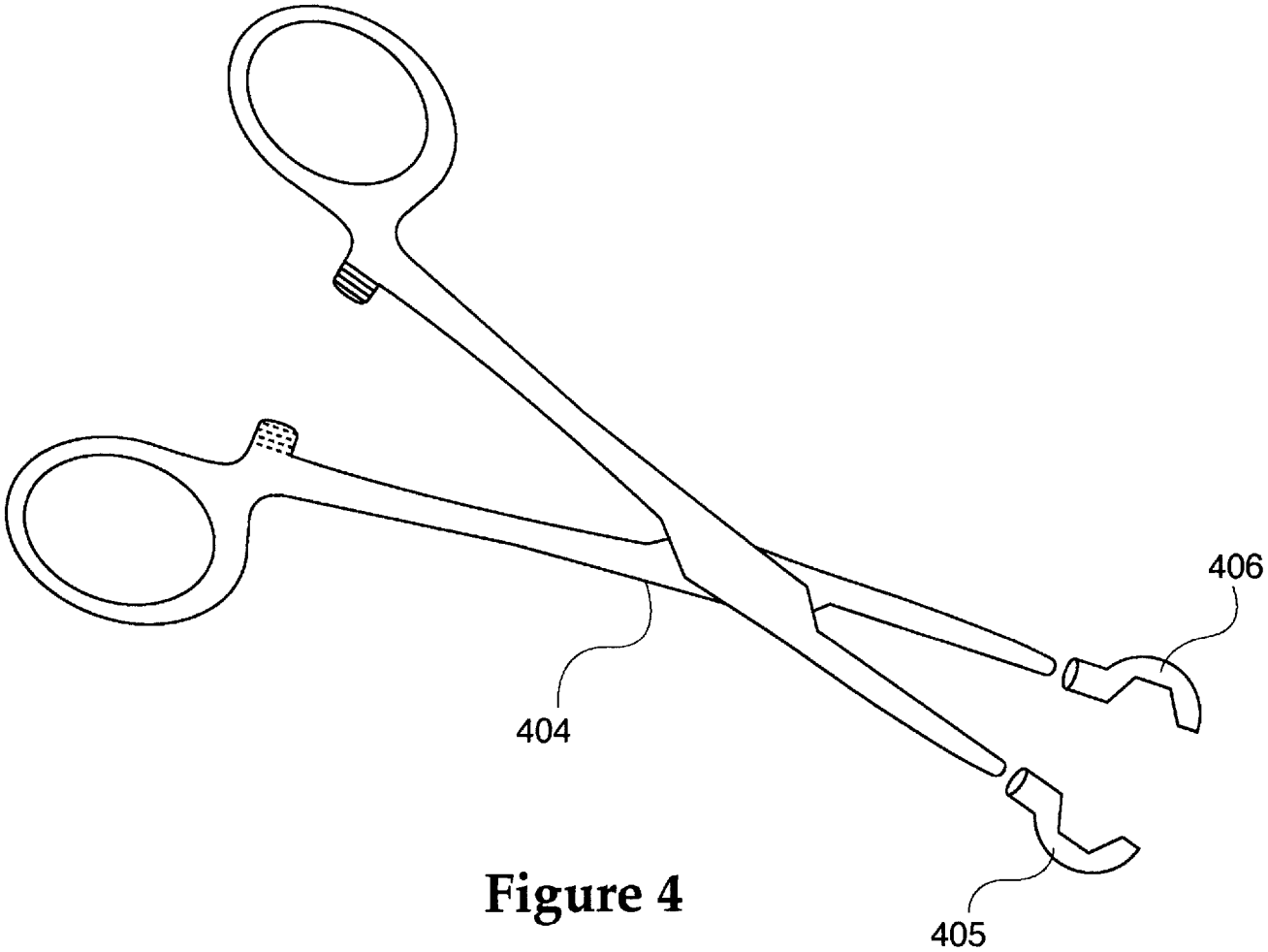
FIG. 4 is an exploded view of an alternative embodiment of the nut starter of the present invention illustrating removable nut starter tips.

FIG. 4 is an exploded view of an alternative embodiment of the present invention. As noted above, there may be a conflict between providing a single nut starter device for each size of nut, versus providing a single nut starter which may grip a plurality of nut sizes. The former approach provides a tool which may better grip nuts in limited access spaces. The latter approach may make such a nut starter set more expensive, as a plurality of nut starters may be required to provide a mechanic with a range of applicable nut sizes.

In FIG. 4, this dilemma has been solved by providing a single truncated forceps device 404 provided with removable nut gripping devices 405 and 406. Truncated forceps device 404 may be similar to the apparatus of FIG. 2, however, the ends of the device may be truncated and formed to accept removable nut gripping devices 405 and 406. Nut gripping devices 405 and 406 may be provided in a plurality of sizes to provide a mechanic or the like with a range of selectable tools for different applications.

Figure 5:
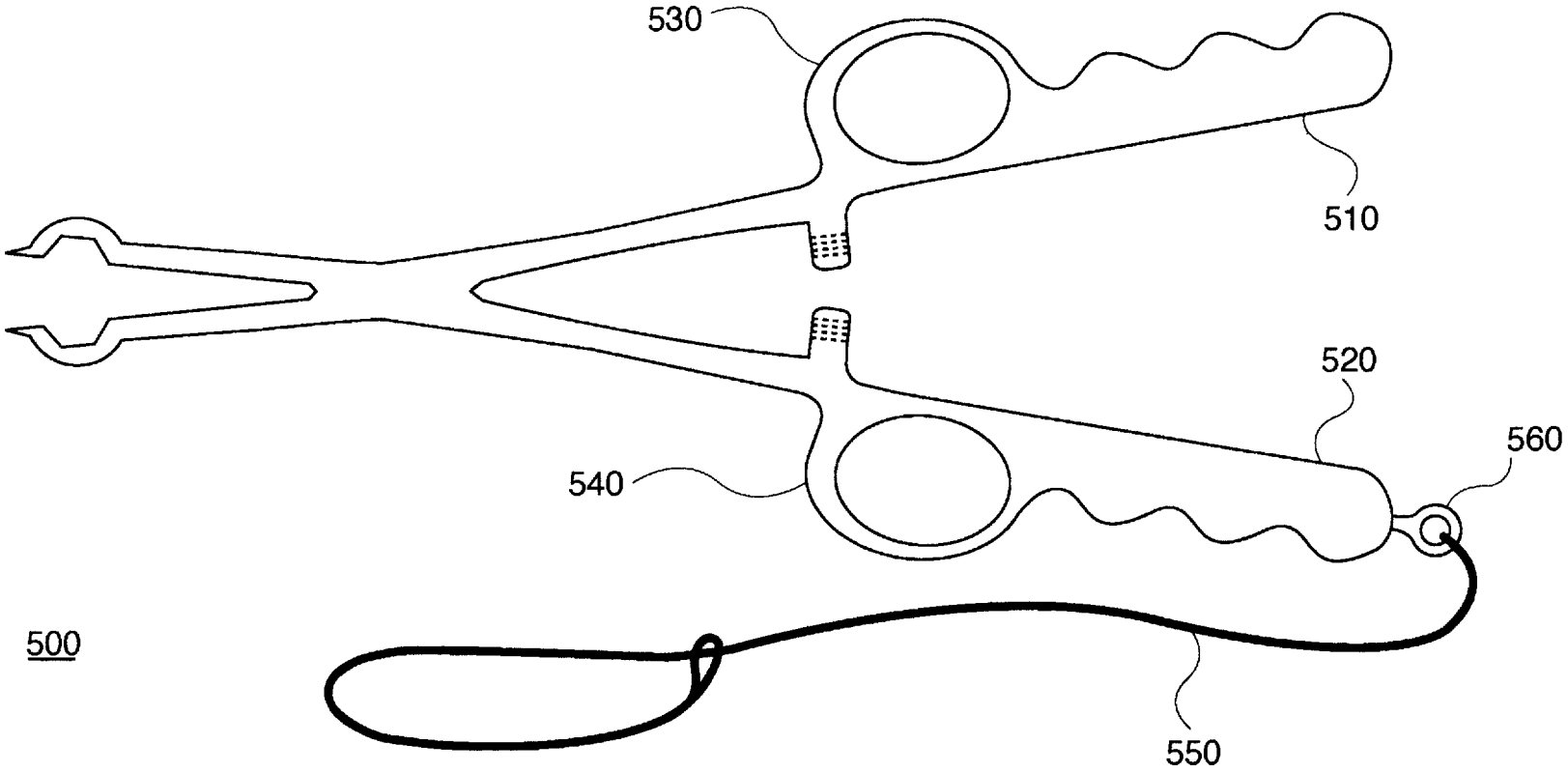
FIG. 5 is a side view of a second embodiment of the present invention illustrating the use of a pistol grip and lanyard for a nut starter.

FIG. 5 is a side view of a second embodiment of the present invention illustrating the use of a pistol grip and lanyard for a nut starter. To reduce the likelihood that a tool will be dropped in a limited access area (e.g., aircraft wing), tool 500 (here illustrated as a nut starter of the first embodiment of the present invention) may be provided with a pistol grip. The pistol grip allows the tool to be held more securely by allowing the mechanic to wrap a hand around both handles 510 and 520.

Trigger holes 530 and 540 may be provided to accept a finger. One or both holes 530 and 540 may be provided. Handles 510 and 520 may be integrally formed within tool 500, or may be applied as a separate piece or pieces (e.g., plastic handle). Trigger holes 530 and 540 allow the apparatus to be locked or unlocked by using an action similar to squeezing the trigger on a gun. Conventional hemostats may use a scissors-like grip when may be less effective in blind or enclosed spaces.

Optionally attached to either of handles 510 and 520 may be lanyard 550. Lanyard 550 may form a loop which may be wound around a mechanic's wrist or attached elsewhere. If tool 500 should be dropped in a limited access area, it may be readily retrieved by pulling on lanyard 550. In addition, lanyard 550 may be wound around tool 500 to hold tool 500 in a closed position, a feature which will be appreciated in conjunction with FIGS. 7 and 8. It will also be appreciated that lanyard 550 may prevent tool 500 from being dropped when working at great heights. Many on-the-job injuries occur when workers are struck by falling tools accidently dropped from great heights above.

Figure 6:
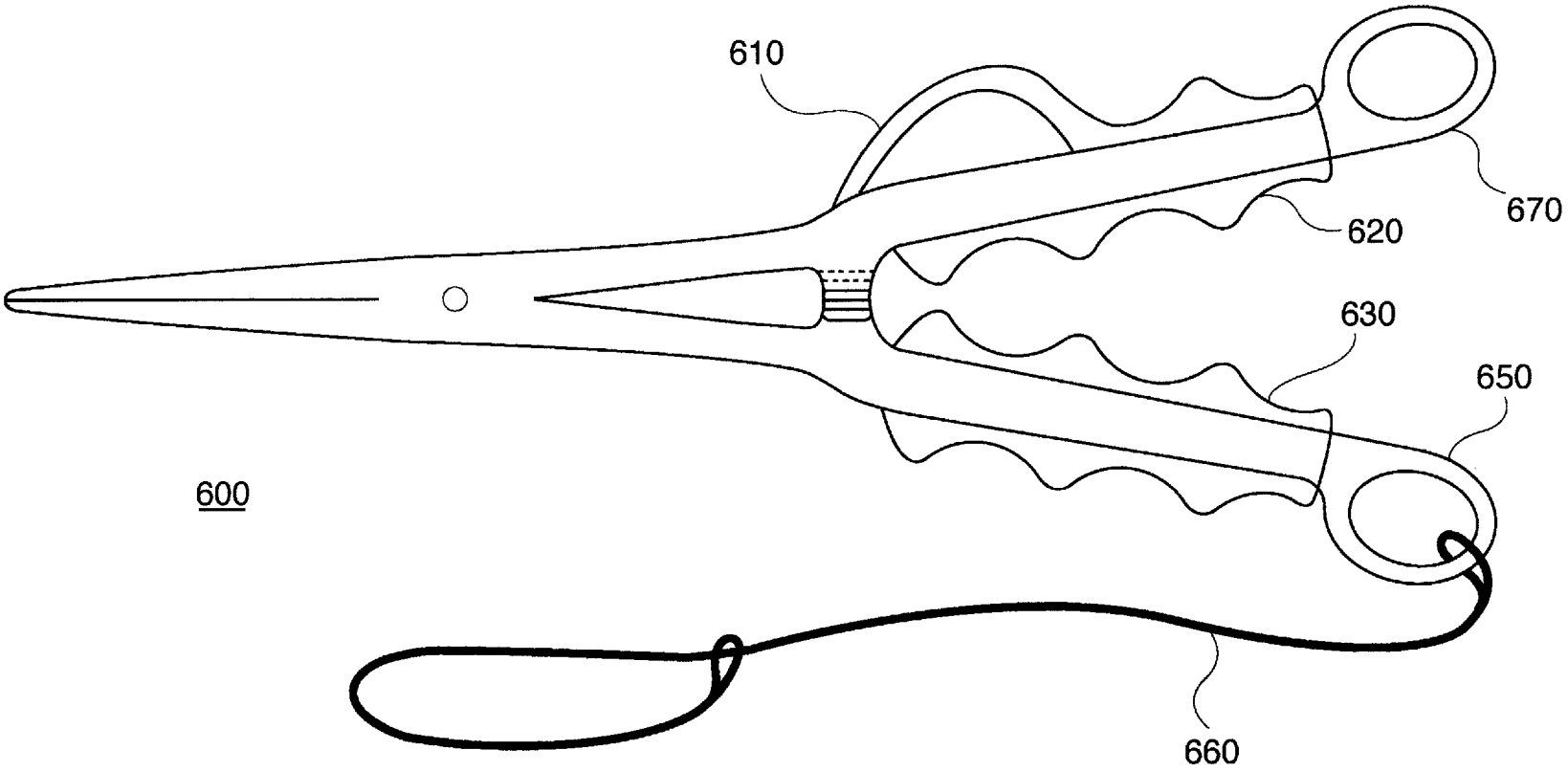

FIG. 6 is a side view of a second embodiment of the present invention illustrating the use of an alternative pistol grip and lanyard for a forceps or the like. Forceps 600 may comprise conventional forceps as illustrated in FIG. 6, or may comprise the nut starters of FIGS. 2–3 and 4 of the present inventions, or other type of gripping device. Forceps 600 may be provided with molded handles 620 and 630 which may be molded to fit the shape of a hand.

Finger loop 610 may be formed to hold a finger when forceps 600 are held in a pistol grip position (as opposed to a scissors position typically used with conventional forceps). Forceps 600 may be optionally provided with conventional finger holes 640 and 650 for conventional gripping as well. Lanyard 660 may be attached to forceps 600 through one of conventional finger holes 640, 650, through finger loop 610, or through a dedicated attachment point (not shown).

Figure 7:
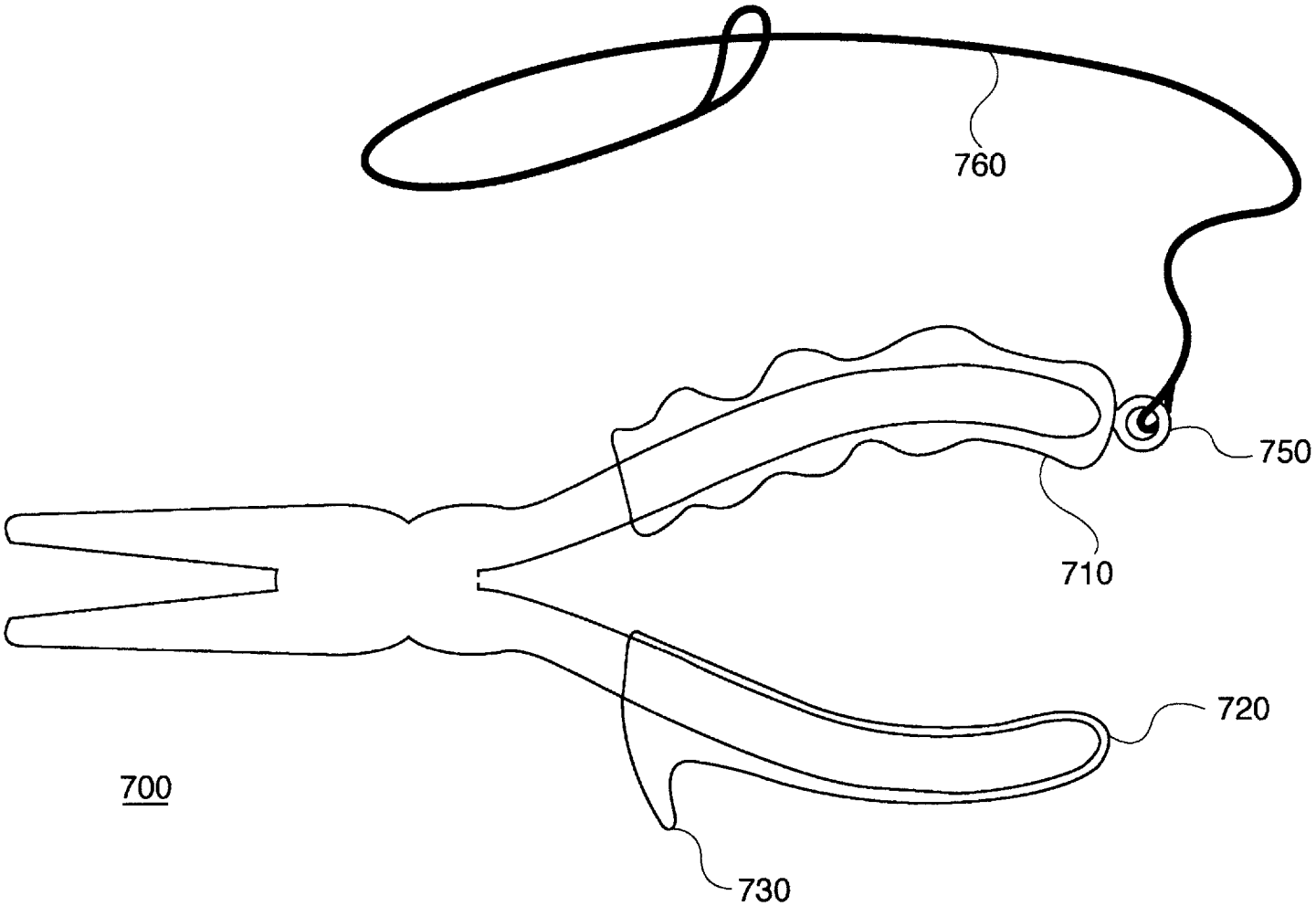
FIG. 7 is a side view of a second embodiment of the present invention illustrating the use of an alternative pistol grip and lanyard for a pair of needle-nosed pliers.

FIG. 7 is a side view of a second embodiment of the present invention illustrating the use of an alternative pistol grip and lanyard for a pair of needle-nosed pliers 700. Pliers 700 may comprise any one of a number of know needle-nose or other types of pliers. A pair of standard needle-nose pliers 700 is illustrated in FIG. 7 for purposes of illustration only and should not be construed as limiting the spirit or scope of the invention in any way.

Pliers 700 may be fitted with molded grips 710 and 720. Again, molded grips 710 and 720 may be made of plastic or other pliable material and fitted to a pair of pliers, or may be molded integrally with the pliers. Handle 720 may be provided with hand retaining portion 730 to allow the side of a hand a surface to rest against. Handles 710 and 720 form a pistol grip allowing pliers 700 to be more effectively gripped.

In the embodiment of FIG. 7, optional lanyard 760 may be attached through loop 750. In addition to retaining pliers 700 to prevent them from dropping, lanyard 760 may be wrapped around grips 710, 720 once an object has been gripped, to lock pliers 700 in place. Lanyard 760 may be made slightly elastic and may be provided with a slip-knot for this purpose.

Figure 8:
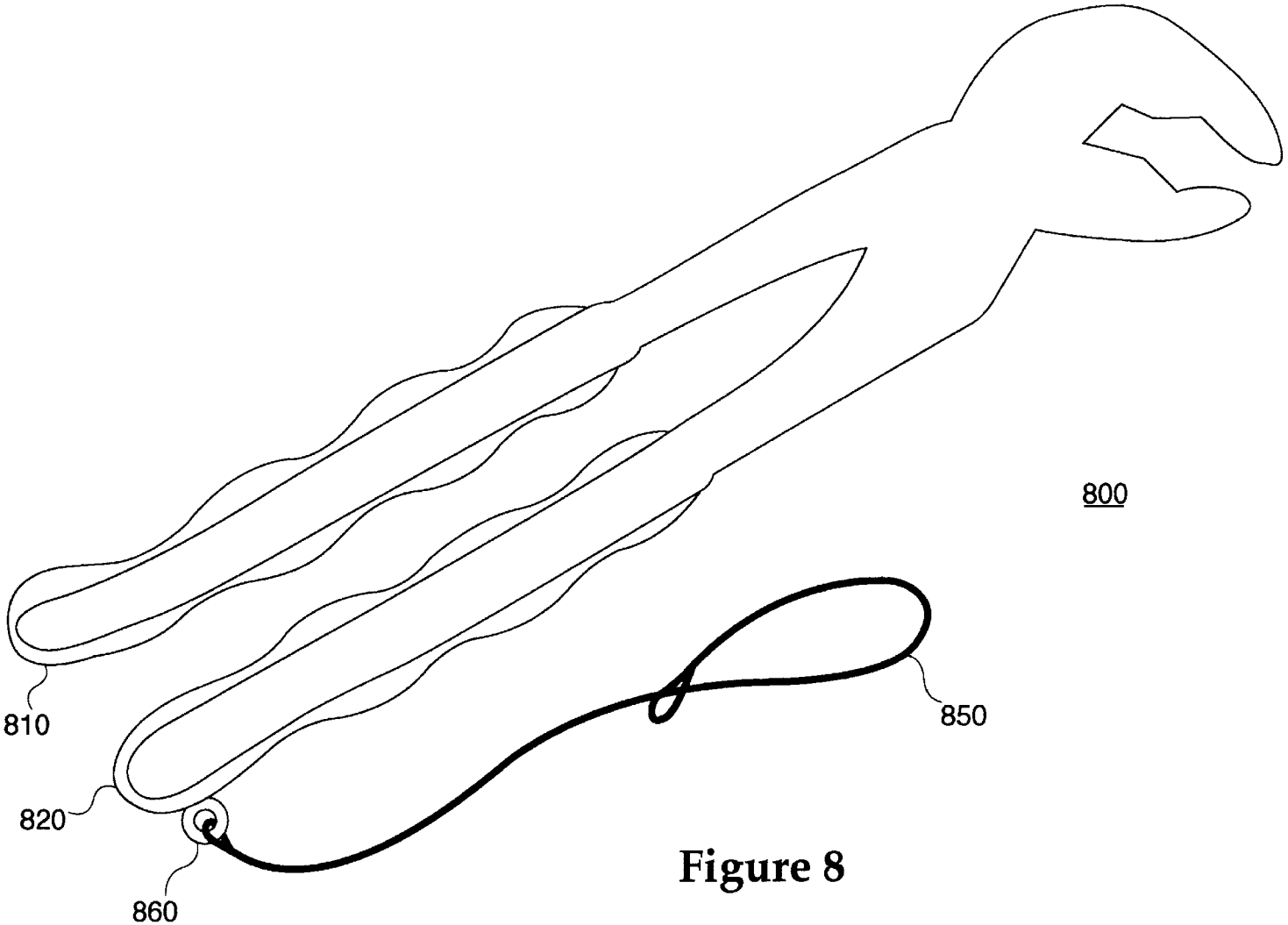
FIG. 8 is a side view of a second embodiment of the present invention illustrating the use of an alternative pistol grip and lanyard for a pair of channel pliers.

FIG. 8 is a side view of a second embodiment of the present invention illustrating the use of an alternative pistol grip and lanyard for a pair of channel pliers. Channel pliers 800 may be a variety or variation of well-know locking pliers such as those manufactured by Channel-Lock™ Corporation. Heretofore, such pliers may generally be provided with simple plastic grips formed by dipping metal plier ends in a plastic solution which hardens on the handle. Such a grip has many disadvantages. In addition to providing little or no cushioning, such grips may be slippery and provide little gripping action for the user. In addition, over time, such coating type grips may slide off the pliers, making grip more difficult and uncomfortable.

Pliers 800 of FIG. 8 solve these problems by providing contoured grips 810 and 820. Contoured grips 810 and 820 may be molded into shaped and attached to pliers 800, or may be formed integrally with pliers 800. Pliers 800 may be formed with contoured handles which in turn may be coated as in the prior art. The contouring of handles 810, 820 may prevent a coating grip from sliding off of pliers 800.

Pliers 800 may also be provided with lanyard 860 connected via loop 850 or the like to prevent loss of pliers 800 in a limited access area. Lanyard 860, in addition to preventing tool 800 from being dropped, may also be wound around handles 810, 820 to lock pliers 800 around an object (nut, bold, pipe, or the like).

While the preferred embodiment and various alternative embodiments of the invention have been disclosed and described in detail, it may be apparent to those skilled in the art that various changes in form and detail may be made therein without departing from the spirit and scope thereof. For example, the nut starter instrument 1 may be available as a 5½" nut starter, which may measure about 6" in length. However, a mix of differing lengths is contemplated; a larger set of hexagonal recesses 8 and 9 may require a larger nut starter instrument 1. Moreover, many of the stated measurements are more illustrative of proportions, and may differ in actual measurements.

Moreover, various modifications may be made within the spirit and scope of the present invention. For example, although FIG. 2 shows two hexagonal recesses 8 and 9, the best mode is not limited to two hexagonal recesses. The number of hexagonal recesses for a mechanics' limited-access nut starter instrument may be variable. For example, there may be nut starter instruments with one, two, or three hexagonal recesses, all of differing sizes.

Finally, it is presently intended to engrave a trademark logo on the nut starter instruments. A nut starter instrument herein described which bears, or in the alternative, does not bear, any marking for trade identification is to be construed as falling entirely within the spirit and scope of the present invention.

What is claimed is:

1. An apparatus for gripping a hexagonal nut of a predetermined standard size, said apparatus comprising:

a first spring steel arm comprising a first thin extended portion bisected by a first hinge portion into first and second extended portions, said first extended portion including a first jaw half shaped in a half-hexagon to conform precisely to a portion of the hexagonal nut of the predetermined standard size, said jaw half formed at a far end of the first extended portion from the first hinge portion such that the first extended portion exerts a spring tension on the hexagonal nut of predetermined standard size, said second extended portion including a first serrated locking extension formed at a far end of the second extended portion from the hinge portion, such that the second extended portion also exerts, through the first hinge portion, a spring tension on the hexagonal nut of predetermined standard size, said second extended portion also including a first grip formed at the far end of the second extended portion, for receiving a human finger;

a second spring steel arm comprising a thin second extended portion bisected by a second hinge portion into third and fourth extended portions, said second spring steel arm joined to said first spring steel arm by a pivot formed by the first and second hinge portions, said third extended portion including a second jaw half shaped in a half-hexagon to conform precisely to a portion of the hexagonal nut of the predetermined standard size, said jaw half formed at a far end of the third extended portion from the second hinge portion such that the third extended portion exerts a spring tension on the hexagonal nut of predetermined standard size, said fourth extended portion including a second serrated locking extension formed at a far end of the second extended portion from the second hinge portion, such that the fourth extended portion also exerts, through the second hinge portion, a spring tension on the hexagonal nut of predetermined standard size, said second extended portion also including a second grip formed at the far end of the second extended portion, for receiving a human finger;

wherein said first and second jaw halves grip and encompass the hexagonal nut of the predetermined size when said first and second arms are pivoted together, said first and second jaw halves being sized slightly smaller than the hexagonal nut of predetermined size, and said first and second arms applying a spring pressure through both first, second, third, fourth extended portions to said first and second jaw halves when said first and second serrated locking extensions are engaged to as to grip the hexagonal nut of predetermined size with a spring tension, said serrated locking extensions maintaining spring pressure on the hexagonal nut of predetermined size once engaged.

2. The apparatus of claim 1, wherein said first and second arms each have an angled portion encompassing said first and second jaw halves so as to allow said first and second jaw halves to engage the hexagonal nut when the hexagonal nut is recessed.

3. The apparatus of claim 2, wherein the hexagonal nut is a hexagonal fastener, and said first and second jaw halves comprise portions formed to engage a hexagonal fastener.

4. The apparatus of claim 3, wherein said first arm further includes a third jaw half and said second arm further includes a fourth jaw half, wherein said third and fourth jaw halves grip an other hexagonal nut when said first and second arms are pivoted together, said third and fourth jaw halves being sized slightly smaller than the other hexagonal nut, and said first and second arms applying a spring pressure to said third and fourth halves when said first and second serrated locking extensions are engaged to as to grip the other hexagonal nut.

5. The apparatus of claim 4, wherein said first and second grips comprise first and second molded portions being shaped to conform to a hand when the hand is wrapped around both grips simultaneously.

6. The apparatus of claim 5, wherein said first grip further comprises:

a trigger grip, for receiving a forefinger, to allow the apparatus to be engaged using a forefinger gripping action.

7. The apparatus of claim 6, further comprising:

a lanyard, coupled to at least one of the first and second grips and wrapped around the hand so as to prevent the apparatus from being dropped if the hand releases the first and second grips.

8. A limited access nut starter for firmly gripping a nut or bolt in a limited access area comprising:

a pair of spring steel forceps comprising two spring steel elongated portions pivoted together at a central hinge portion, said spring steel forceps formed with a hexagonal portion on a working end thereof for gripping and holding a hexagonal object when the forceps are clamped, the hexagonal portion on the working end having an inside dimension smaller than the outside dimension of the hexagonal object said forceps further formed with a ratchet portion on an opposite end from the working end, said ratchet portion locking the forceps in a closed position such that the ratchet maintains a spring pressure through substantially all of the spring steel elongated portions onto the hexagonal object.

9. The limited access nut starter of claim 8, further comprising a second a hexagonal portion on the working end of the forceps for gripping and holding an other hexagonal object when the forceps are clamped, the second hexagonal portion on the working end having an inside dimension smaller than the outside dimension of the other hexagonal object.

10. The limited access nut starter of claim 9, wherein the forceps include first and second grips comprising first and second molded portions being shaped to conform to a hand when the hand is warped around both grips stimultaneously.

11. The limited access nut starter of claim 10, wherein said first grip further comprises:

a trigger grip, for receiving a forefinger, to allow the apparatus to be engaged using a forefinger gripping action.

12. The limited access nut starter of claim 11, further comprising:

a lanyard, coupled to at least one of the first and second grips and wrapped around the hand so as to prevent the apparatus from being dropped if the hand releases the first and second grips.

* * * * *